US006490903B2

(12) United States Patent
Ravenet et al.

(10) Patent No.: US 6,490,903 B2
(45) Date of Patent: Dec. 10, 2002

(54) METHOD AND A DEVICE FOR THERMAL CONTROL OF THE PROFILE OF A ROLL IN A MILL

(75) Inventors: André Ravenet, Les Mureaux (FR); Thierry Malard, L'isle Adam (FR)

(73) Assignee: Vai Clecim, le Polyedre, Nanterre Cedex (FR)

( * ) Notice: Subject to any disclaimer, the term of this patent is extended or adjusted under 35 U.S.C. 154(b) by 0 days.

(21) Appl. No.: 09/756,113

(22) Filed: Jan. 9, 2001

(65) Prior Publication Data

US 2001/0007200 A1 Jul. 12, 2001

(30) Foreign Application Priority Data

Jan. 10, 2000 (FR) ..... 00 00243

(51) Int. Cl.[7] ..... B21B 27/06
(52) U.S. Cl. ..... 72/236; 72/201
(58) Field of Search ..... 72/201, 236, 200, 72/202, 342.2, 342.3

(56) References Cited

U.S. PATENT DOCUMENTS 4,444,495 A * 4/1984 Bramwell et al. ..... 72/201
4,644,774 A * 2/1987 van Steden ..... 72/201
4,706,480 A 11/1987 Svatos
4,912,955 A * 4/1990 Stines ..... 720/201
5,212,975 A * 5/1993 Gizburg ..... 72/201
5,694,799 A * 12/1997 Wolpert et al. ..... 72/201
5,799,523 A * 9/1998 Seidel et al. ..... 72/201
6,014,881 A * 2/2000 Imanri ..... 72/201

FOREIGN PATENT DOCUMENTS

EP 62173013 7/1987
EP 0 542 640 A 5/1993
JP 9 267106 10/1997

OTHER PUBLICATIONS

Database WPI Section Ch, Week 198248: Derwent Publications Ltd., London, GB; XP002113727.
SU 900 894 A (Ferr Metal Effl Purif) Jan. 30, 1982.

* cited by examiner

*Primary Examiner*—Ed Tolan
(74) *Attorney, Agent, or Firm*—Arent Fox Kintner Plotkin & Kahn

(57) ABSTRACT

The invention relates to a method for thermal control of the profile of a roll in a mill by spraying, over a cooled zone (4) of the roll (1), a series of jets of fluid (J), each forming an oblong impact surface (S). According to the invention, the distance (a) between the middle axes of the impact surfaces (S) is caused to vary in relation to the position of the said impact surfaces over the length of the cooled zone (4) so that the said zone comprises a central zone (41, 43) with a substantially constant pitch and whereas two transition zones (44) extend on either side of the central zone at least up to two edges (13) of the band (M) and in which the spacing between the middle axes of the impact surfaces (S) is reduced with respect to the constant pitch (a) of the central zone (41, 43).

25 Claims, 7 Drawing Sheets

12a

12b

12c

METHOD AND A DEVICE FOR THERMAL CONTROL OF THE PROFILE OF A ROLL IN A MILL

This invention relates to a method and a device for thermal control of a roll profile in a rolling mill.

A metallic band rolling installation comprises, generally, one or several roll stands each containing at least two working rolls and associated with means for controlling the passage of a band to be rolled between the said rolls.

Usually, each roll stand comprises two supporting stanchions, spread apart and connected by crossbeams between which is mounted a set of superimposed rolls with axes parallel and placed substantially on the same clamping plane substantially perpendicular to the feeding direction of the product.

Rolling mills of different types can be made. Generally, in a rolling mill, the product to be rolled passes between two working rolls that delineate the rolling plane; the diameter of these rolls is preferably reduced in comparison to the loads to which they are exposed and these rolls rest respectively on at least two back-up rolls between which the rolling load is applied.

The so-called 'quarto'-type rolling mills comprise therefore four superimposed rolls, respectively two working rolls associated, respectively, to two back-up rolls of larger diameter.

In 'sexto'-type rolling mills, intermediate rolls are interposed between each working roll and the corresponding back-up roll.

Other types of rolling mill, comprising more or fewer rolls are known and used in the industry.

The rolls rest on one another along back-up lines substantially parallel and directed according to a generatrix whose profile, normally rectilinear, depends on the loads applied and on the resistance of the rolls. Generally, the clamping load is applied by screws or actuators interposed between the roll stand and the ends of the shaft of the upper back-up roll, whereas the lower back-up roll rests by its ends directly on the roll stand.

The clamping loads are applied between both ends of both back-up rolls. Since the rolled product, variable in length, does not cover the whole length of the working rolls, each roll may sag under the action of the loads applied and the thickness of the feeding space of the band between the working rolls may therefore vary, since the edges of the band could hence be thinner than the central part. These thickness defects also lead to flatness defects of the rolled band, particularly in the case of cold rolling and with thin thicknesses.

For quite a long time, one has tried to correct these thickness defects on the profile across the rolled product and various means have been used to that purpose. For example, it has been suggested to compensate for the deformation of the rolls caused by the rolling action, by cambering their surface thanks to machining to a particular profile. Its has also been suggested to perform continuous adjustable correction, by cambering the working rolls, generally small in diameter, while applying controlled deflection loads on both ends of their shaft.

More recently, it was suggested to distribute the loads on the width of the rolls by giving an adjustable profile to at least one of the back-up rolls. Such a roll comprises a deformable shell mounted rotatable around a fixed shaft on which the clamping load is applied and resting on this shaft via a set of actuators whose position and/or pressure are adjustable individually thanks to a regulation system, according to the flatness measured on the band, downstream of the rolling stand, whereas the thickness defects thus determined are compensated for by acting on the distribution of the loads over the width of the band.

These thickness defects are caused essentially by the rolls that are flattened by the load applied and the actuators suggested act on the profile of the back-up generatrix in order to modify the general aspect of the deformation, but do not allow local correction of the roll profile in cross section, at a given place.

It has also been suggested to compensate for the flattened rolls or at least the irregular flattening over the whole width, by varying the diameter obtained locally by thermal expansion.

Indeed, rolling generally produces a lot of heat due to the friction of the band rolled between the working rolls and it is therefore necessary to cool them down. In this view, at least one of the rolls, normally a working roll, is associated with a spray ramp with a heat exchanging fluid and comprising a plurality of spraying members spaced apart from another along a direction parallel to the axis of the roll and each provided with a spray nozzle with a jet of fluid directed towards one face of the roll turned to the ramp and whose flow rate is determined, for each spraying member, via a valve controlled individually by an adjustment system.

This thermal effect must be limited to the portion of the roll that covers the running band and it is the reason why the adjustment system of the flow rates determines the opening of the valve of the spraying members over a limited portion of the ramp that determines the spraying of the fluid over a cooled zone of the roll corresponding to the width of the rolled band and the closing of the valves over the remaining portions of the ramp.

Each spray nozzle is usually provided with a slot enabling to deliver a flat jet centred on a middle plane that cuts transversally the axis of the roll in order to form an oblong impact surface with a small width and extending over a portion of the height of the roll.

The cooled zone therefore consists of a series of impact surfaces substantially parallel and spaced apart from one another by a distance slightly greater than the width of each surface.

Preferably, the middle planes of the flat jets, in which are placed the greater axes of the impact surfaces are tilted with respect to the axis of the roll, so that the impact is spread, on the left and on the right, on either side of the centre of the jet, while covering a width that protrudes slightly above and beneath the centres of the adjacent jets, without interference between the impact surfaces.

Moreover, the average flow rate, per time unit, of the jet of sprayed fluid onto each impact surface can be adjusted individually by the flow rate adjustment system. It is thus possible to control accurately, per truncated zones, any variation of the profile, in cross section, of the roll over the whole length of the cooled zone, in order to modify the distribution of the loads in order to correct the flatness defects detected downstream.

Such systems have proven their efficiency, particularly for rolling thin bands and very thin bands. They have been used, initially, for rolling non ferrous metals, in particular, aluminium, owing to the low thermal inertia due to the small thickness and the malleability of the metal. However, more recently, it has been sought to apply this thermal control method to the rolling of ferrous metals.

Thanks to all these new means, the flatness quality of the rolled sheets could be improved. However, because of this improvement, residual defects, which had not been taken into account previously, have been put in evidence on the edge of the rolled bands, especially the thinnest bands.

The invention obviates this shortcoming while making improvements to the systems used until now for controlling mill rolls that enable to obtain as perfect as possible a flatness quality.

In this view, the invention uses a thermal control system of conventional type, in which at least one roll of the mill is associated with at least one spray ramp with a fluid to control, per truncated zones, the effect of the fluid jets over a cooled zone of the roll.

According to the invention, the distance between the middle axes of the impact surfaces is caused to vary in relation to the position of the said impact surfaces of the fluid jets over the length of the cooled zone so that the said zone comprises a central zone in which the middle axes of the impact surfaces are spaced by a substantially constant pitch and whereas two transition zones extend on either side of the central zone at least up to two edges of the band and in which the spacing between the middle axes of the impact surfaces is reduced with respect to the pitch of the central zone.

According to a particularly advantageous embodiment of the invention, the spraying ramp comprises a central portion with constant pitch, corresponding to the central zone of the cooled zone, in which each fluid jet is directed along an injection axis perpendicular to the axis of the roll and two lateral portions with reduced pitch, in which the orientations of the axes of the jets with respect to the axis of the roll are caused to vary, so that they may converge respectively toward two transition zones on either side of the central zone of the roll, whereby the number of convergent jet nozzles is such that, taking into account their distribution on the ramp, each lateral portion of the ramp covers a length greater than that of the corresponding transition zone of the roll.

Preferably, the middle planes of the jets directed to the central zone of the roll are tilted by a same non-zero angle with respect to the axis of the roll and the tilting angle of the middle planes of the jets directed respectively to both transition zones is increased progressively, as the corresponding impact surface is spread away from the central zone.

The invention applies therefore to a thermal control device comprising, in a known fashion, at least one spray ramp consisting of a plurality of spraying members spaced apart and fed with a heat exchanging fluid and each provided with a valve associated with an individual adjustment system of the flow rate sprayed by each spraying member.

According to the invention, as the width of the product to be rolled can vary between a minimum width and a maximum width, the spraying ramp comprises at least three series of spraying members, respectively, a central series covering a central portion of the cooled zone over a length not exceeding the minimum width of the product and in which the spraying members have fixed directions so that the axes of the corresponding impact surfaces are spaced by a constant pitch in the said central portion of the cooled zone and two lateral series extending on either side of the central series to cover, in total, a length at least equal to the maximum width of the product and in which the spraying members are mounted pivoting on the ramp, whereas each lateral series is associated with a means for adjusting the orientation of at least one group of pivoting spraying members, in order to reduce the spaces between the axes of the impact surfaces in a transition zone at each end of the cooled zone of the roll.

According to a preferred embodiment, as the band to be rolled is centred in a longitudinal plane of symmetry of the mill, each lateral series of spraying members comprises, considered from the inner side to the outer side, a first section in which the axes of the jets are at right angle to the axis of the roll and that covers a first lateral portion of the cooled zone of the roll over a length such that the total length of the central portion of the cooled zone, increased by the said first lateral portions is smaller than the width of the band, and a second section in which the axes of the jets are tilted inwardly with respect to the axis of the roll and that covers a second lateral portion of the cooled zone over a length such that the total length of the said cooled zone is at least equal to the width of the band, whereas each second section of a lateral series covers, at one end of the cooled zone, a transition zone corresponding to an edge of the band and in which the middle axes of the impact surfaces are spaced by a distance smaller than the spacing pitch of the said surfaces, respectively in the central portion and the first lateral portions of the cooled zone.

According to a particularly advantageous embodiment, the adjustment means for orienting the jets comprise two means for controlling the pivoting of one group of spraying members, respectively on each lateral series, whereas each control means is moveable along the ramp and associated with a means for adjusting its position in relation to the width of the band and with a means for selective engagement of the said control means with a group of spraying members making up a second section of each lateral series to cover a transition zone, at each end of the cooled zone.

Usually, each spraying member comprises a tubular body exhibiting an outlet end provided with a jet formation nozzle and an inlet end connected to the duct via a connection piece delineating a junction channel between the inner side of the duct and the inlet end of the tubular body, on which is placed a valve connected individually to the adjustment system.

According to the invention, in each lateral series of the ramp, each spraying member comprises a tubular body mounted pivoting on the connection piece around at least one axis orthogonal to the axis of the roll.

To adjust the orientations of the jets, each lateral series of spraying members is associated with a means for selective control of the pivoting of a group of spraying members comprising a cursor provided with fingers spaced apart and mounted to slide on a support, along an axis parallel to the feeding duct of the ramp, a means to control the sliding motion of the cursor on its support for adjusting the position of the cursor along the ramp and a means to control the rotation of the cursor around its axis into two opposite directions, respectively, an engagement and a disengagement directions of the cursor fingers between the tubular bodies of a group of spraying members of the ramp.

According to a preferred embodiment, the fingers of the cursor are spaced apart by a constant distance that is slightly smaller than the distance between the axes of the tubular bodies of two neighbouring spraying members, whereby the said fingers of the cursor rest one after the other on the said tubular bodies as the cursor is sliding, in order to determine progressive variation of the tilting angles of the jets with respect to the axis of the roll.

But the invention also covers other advantageous characteristics that are subject to sub-claims and will appear in the following description of a particular embodiment, given for exemplification purposes and represented on the appended drawings.

FIGS. 12*a–c* illustrate schematically the different adjustment possibilities.

Figure 1:
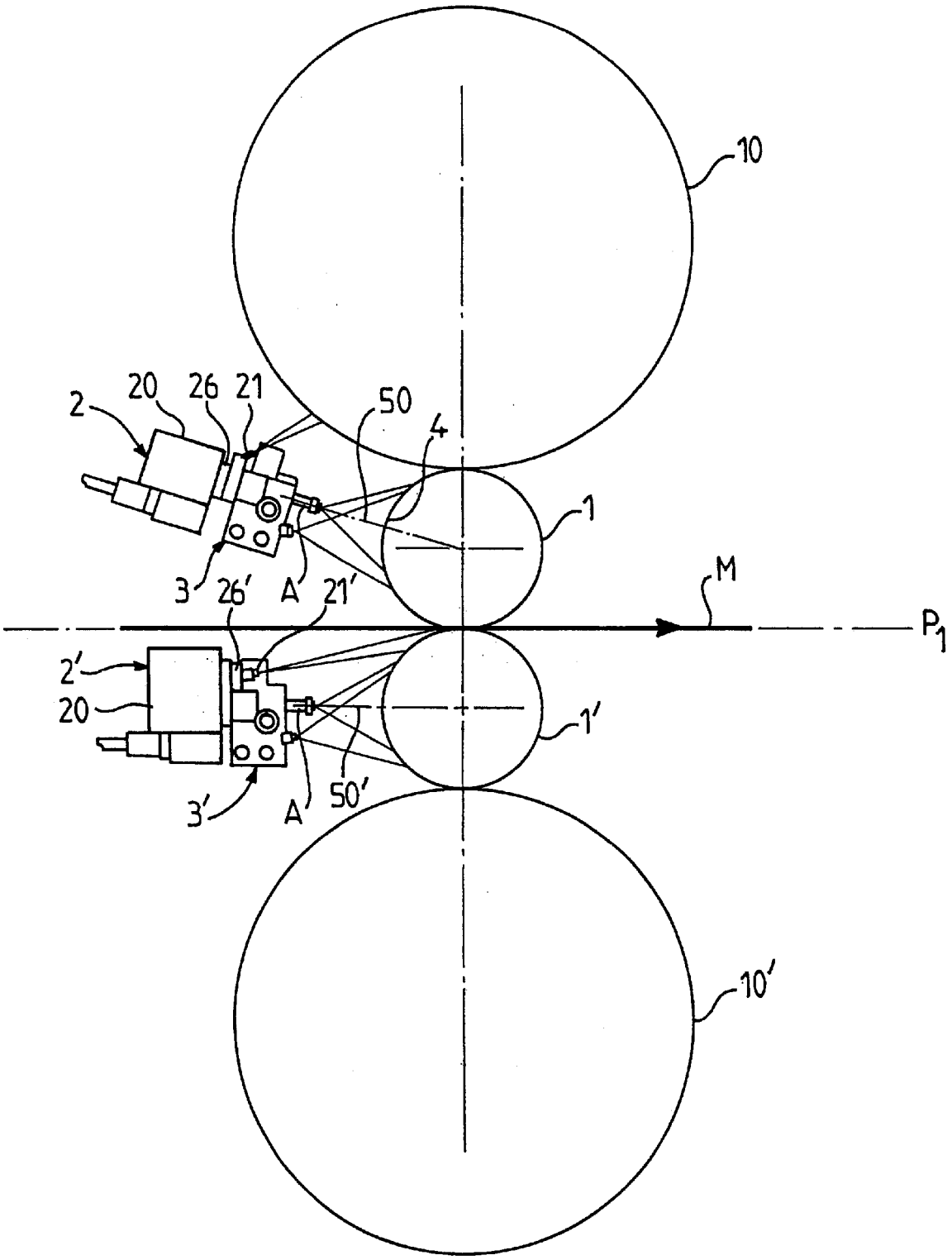
FIG. 1 represents schematically, as a top view, the set of rolls of a quarto-type rolling mill provided with two spray systems, respectively, of both working rolls.
Figure 2:
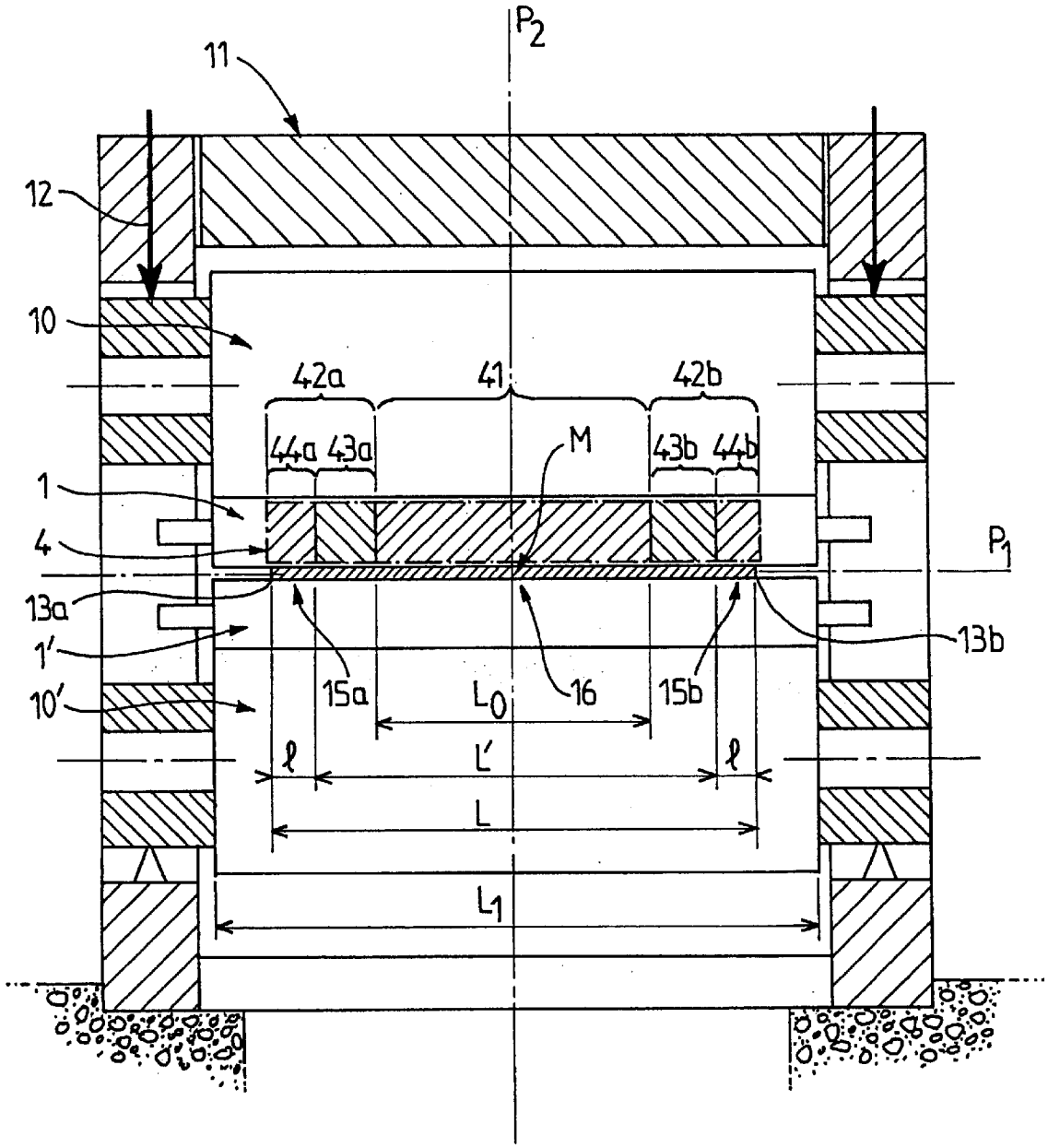
FIG. 2 is a schematic front view of the set of rolls.

FIGS. 1 and 2 represent schematically, respectively as a cross section and as a front view, the whole quarto-type rolling mill, comprising four superimposed rolls, respectively two working rolls 1, 1' and two back-up rolls 10, 10', whereas the set is placed inside a roll stand 11 carrying means 12 for applying clamping loads to the ends of the shaft of one of the back-up rolls 10, whereas the other back-up roll 10' rests on wedges. Thus, a product M can be rolled, along a horizontal running plane $P_1$, between both working rolls 1, 1'. Normally, the product M is centred on a vertical plane of symmetry $P_2$ of the roll stand.

The product to be rolled M consists of a metal band with two edges 13*a*, 13*b* spaced by a width L which, in relation to the type of product to be rolled, may vary between a minimum width $L_0$ and a maximum width $L_1$. Generally, the width L of the product is smaller than the length of the working rolls whose back-up generatrix 14 is applied onto the product, only over a portion of its length. As a result, as stated above, the rolling load applied by the clamping means 12 between the rolls determines a deflection of the said rolls that modifies the distribution of the loads along the back-up generatrix 14, whereas both edges 13*a*, 13*b* of the band are generally more compressed than the central portion.

This causes flatness defects that can be compensated for while acting onto the profile of the rolls.

As stated above, we know, especially, mechanical devices for correcting flatness defects exerting deflection loads, in one direction or the other, on the ends of the working rolls or acting on the profile of a back-up roll consisting of a deformable shell rotating round a fixed shaft.

These devices enable considerable improvement in the flatness quality of the rolled bands. However, there are still residual defects on both edges of the band and it has appeared that, even for very thin bands, these residual defects could be due to sudden discontinuity in the distribution of the loads that takes place at each edge, since the working roll extending from the former is not applied to the product.

Still, the mechanical flatness correction devices in which the distribution of the loads is corrected by cambering the working rolls or while using a backup roll with a deformable shell, do not allow to adapt locally the profile of the working rolls in order to take into account this discontinuity since the deformation of the roll is necessarily gradual.

Moreover, in the case of very thin bands, the working rolls engage one another outside the band, which limits the correction possibilities.

As we have seen, it is also possible to control thermally the profile of the rolls by spraying fluid into truncated zones. However, the devices used, until now, to this end, did not enable to adjust with sufficient accuracy, the profile of the roll at each edge.

Indeed, the spraying members have necessarily minimum sizes that depend on the flow rate of fluid to inject and on the space requirements of the mechanical parts and it is not possible to reduce these space requirements below a certain threshold.

Moreover, the miniaturisation of the components used is not compatible with their reliability. Still, as the flatness defects appearing on a band running at very high speed must be corrected, the valves associated with the adjustment members and enabling to control the average flow rate of the spray are actuated alternately, at opening and closing, with a period of a few seconds only. Besides, it has now become usual to operate an installation continuously for very long periods, possible several months and the stoppages, in normal operation, are too short to enable adjustments or replacement of faulty parts.

This is the reason why, according to the invention, instead of seeking to reduce the space requirements of the spraying members as far as possible, spraying members with the necessary sizes are used, conversely, to ensure their reliability and, in order to improve the accuracy of thermal control, the orientations of the jets are simply caused to vary at both ends of the ramp in order to reduce the distance between the middle axes of the impact surfaces over a transition zone with adjustable width, at each lateral edge of the band.

In practice, this transition zone may be 30 to 40 mm wide and the spacing between the axes of the impact surfaces of the jets may be reduced, for instance, up to half the spacing pitch that corresponds, in the central zone, to the minimum space requirements of the spraying members.

In the case represented on FIG. 1, of a quarto-type rolling mill, two spraying devices 2, 2' are used, placed respectively on either side of the running plane $P_1$ of the band M to be rolled and each comprising at least one ramp 3, 3' for spraying a heat exchanging fluid onto a lateral face 4 of the corresponding working roll 1, 1'.

Generally speaking, each spraying ramp 3, 3' consists of a plurality of spraying members A arranged side by side, equally spaced from one another, on a supporting block 20 forming a rigid beam carried, at its ends, by both stanchions of the roll stand 11 and that extends parallel to the axis of the working roll 1, over the whole length of the said roll.

In a known fashion, each cooling device 2, 2' may also comprise a second fluid-spraying ramp 21, 21'. This second ramp is directed to the upper back-up roll 10, above the band M and in the space delineated between the said band and the lower working roll 1', beneath the band.

Such an arrangement need not be symmetrical, since the fluid may be distributed by gravity to ensure lubrication of all the rolls.

Each spraying member A consists of a tubular body 5 fixed by a connection piece 26 to the supporting block 20, 20' in which are arranged supply ducts, respectively 22 for the main spraying ramp 3, 3' and 23 for the secondary ramp 21, 21'.

Each connection piece 26 of a spraying member A is put in communication with the supply duct 23 via a linking channel 24 on which is placed a solenoid valve 25 controlled individually in order to adjust the feeding rate of the spraying member A. At its opposite end, the tubular body 5 is closed by a nozzle 52 provided with a slot in order to form a thin flat jet of fluid J, centred on an axis 50 and with a middle plane $P_3$ that cuts transversally the axis x'x of the roll.

As shown on FIG. 1, the supporting blocks 20, 20' of both spraying devices 2, 2' are oriented so that the axes 50 of the fluid jets formed by each ramp 3, 3' are placed on planes running substantially through the axes of the corresponding working rolls 1, 1'.

Each fluid jet J hits therefore the face 4 of the roll turned towards the ramp 3 following an oblong surface S substantially in the form of a curved rectangle with a great axis transversal to the axis x'x and exhibiting a small width with respect to the distance between the axes of two neighbouring jets, so that there is no interference between the impact surfaces. The cooling effect can thus be adjusted locally by truncated zones.

All these arrangements are conventional and do not call for any more detailed description.

Figure 3:
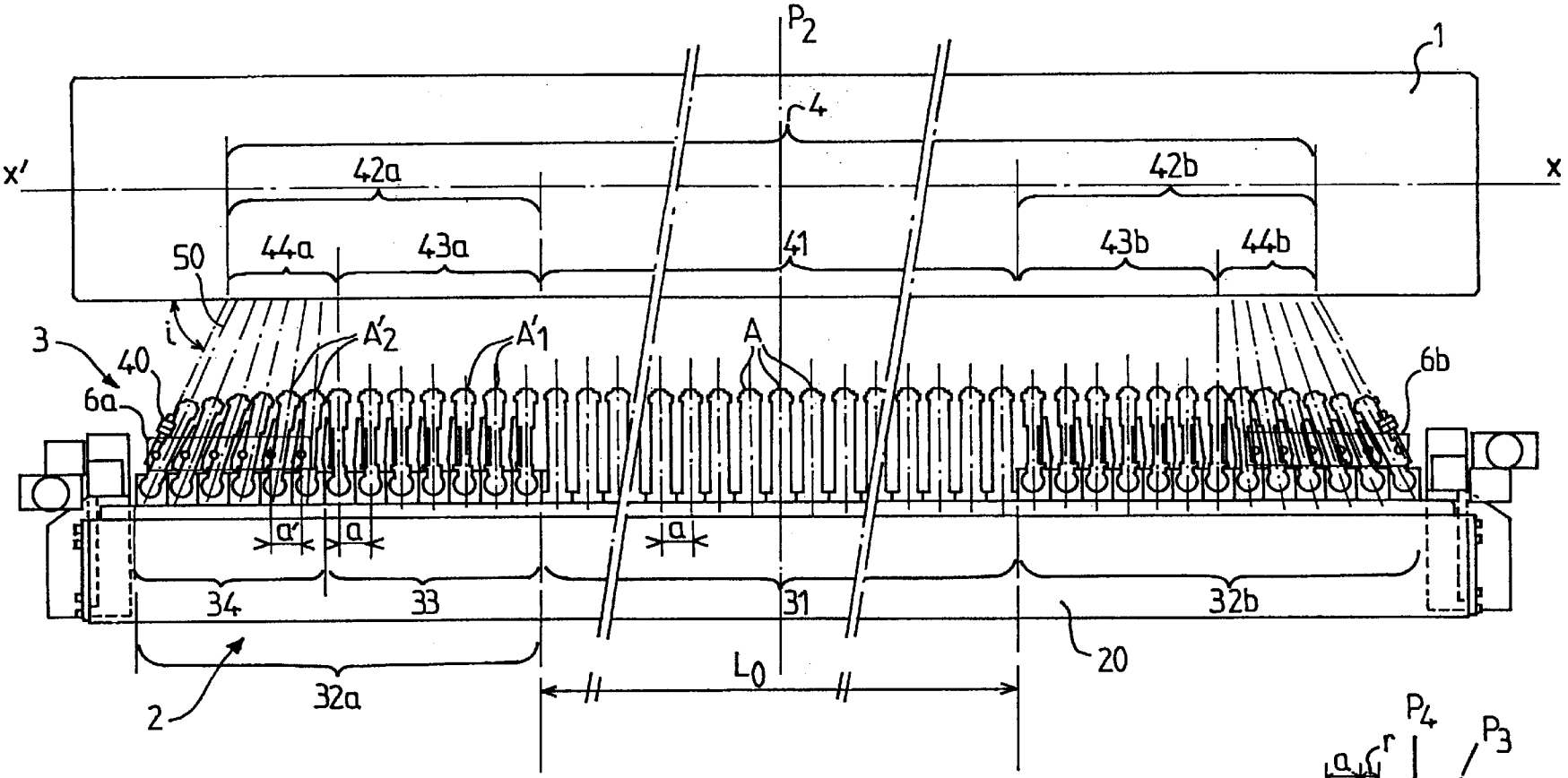
FIG. 3 is a schematic plan view of the whole spray ramp.

The invention differs from the spraying devices used normally by the fact that the spraying ramp 3 consists, as represented schematically on FIG. 3, of three series of spraying members, respectively a central series 31 made of spraying members A that are fixed rigidly to the supporting block 20 and two lateral series, respectively 32*a*, 32*b*, made of steerable spraying members A' that are mounted to pivot on the supporting block 20 and whose orientation can be adjusted with respect to the sprayed face of the roll 1.

As stated above, each spraying member A, A' must exhibit sufficient sizes to ensure reliable operation. The connection pieces 26 are therefore spaced from one another, along the ramp 3, by a constant pitch (a) that corresponds to the minimum space requirements of the spraying members.

The number of fixed spraying members A making up the central series 31 of the ramp 3 is determined, in relation to the spacing pitch (a), in order to cover a length of the same order as the minimum width $L_0$ of the band. The axes 50 of the sprayed jets are perpendicular to the axis x'x of the roll 1 so that the impact surfaces of the jets J are spaced by the same pitch.

The steerable spraying members A' of each lateral series 32*a*, 32*b* are spaced by the same pitch (a) and their number is determined in relation to the remaining length $(L_1-L_0)/2$ of the ramp, in order to cover the maximum width $L_1$ of the band.

However, as already stated above, the length of the cooled zone 4 must be limited to the efficient portion of the roll. To this end, the solenoid valves 25 associated with each spraying member A, A' are controlled individually by a system for adjusting the flow rates that determines, in relation to the efficient width L of the band, the number of spraying members whose valves are open.

As usual, the length of the ramp, i.e. the distance between the axes of the nozzles arranged respectively at both ends of the said ramp, corresponds substantially to the maximum width $L_1$ of the product. When the width L of the product is smaller than that of the maximum width, there is therefore, at each end of the ramp 3, a certain number of spraying members corresponding to the portion of the roll 1 that is not covered by the band and whose valves are hence closed.

FIG. 2, for instance, represents schematically a rolling mill with a maximum width $L_1$. It can be seen that if the product exhibits a width L, the valves of the spraying members are open only over a central portion of the ramp covering the same length L of the roll as the product and are closed at both ends, on a length $(L_1-L)/2$.

In the usual arrangement, the fluid is distributed regularly over a cooled zone of the working roll 1, that extends over a length substantially equal to the distance L between both edges 13*a*, 13*b* of the product, whereas the remaining portions of the roll 1 are not cooled down.

In the invention, conversely, the cooled zone 4, which is represented with hatched lines on FIG. 2, is divided into several portions.

In the central portion 16 of the band, that extends over a width L' on either side of the plane of symmetry $P_2$, thermal control of the distribution of the loads can be performed conventionally, by spraying fluid jets spaced regularly over a central zone of the corresponding face of the working roll 1. Conversely, on either side of this central zone, the spacing pitch of the impact surfaces of the fluid jets is closer in order to provide two transition zones corresponding, respectively, to the edge zones 15*a*, 15*b* of the band and in which thermal control is ensured with greater accuracy in order to correct possible residual defects.

To this end, as stated above, the spraying ramp 3 comprises three series of spraying members, respectively a central series 31 and two lateral series 32*a*, 32*b*. The assembly is represented schematically on FIG. 3.

The central series 31, that is centred on the plane of symmetry $P_2$ of the rolling mill, consists of fixed spraying members A, whose axes 50 are parallel to one another and perpendicular to the axis x'x of the roll.

Conversely, each lateral series 32*a*, 32*b* consist of steerable spraying members A' that are mounted to pivot on the supporting block 20 in a fashion that will be described in detail below and whose orientation can be determined using a cursor 6. The said cursor moves along the ramp 3, parallel to the axis x'x of the roll and can engage into a certain number of spraying members 42 of each lateral series 32.

In the example represented on FIG. 3, the band to be rolled exhibits a length L close to the maximum width $L_1$ of the band. Both cursors 6*a*, 6*b* that will be described in detail below, are therefore placed at both ends of the ramp 3 in order to cause two groups of spraying members, arranged respectively at both ends of the ramp 3 and each comprising, for instance, six spraying members, to converge towards the inside of the band, i.e. towards the plane of symmetry $P_2$.

Each lateral series 32 comprises therefore two sections, respectively a first section 33 and a second section 34.

In the first section 33 that extends in the continuity of the central series 31 at each end of the said central series, the spraying members A'1 are directed perpendicular to the axis x'x of the roll. In the second section 34 that extends beyond the section 33 up to the end of the effective portion of the ramp 3 whose valves are open, the spraying members A'2 steered by the cursor 6, converge towards the inside of the band.

Each portion of the ramp 3 thus delineated determines the spraying of a corresponding portion of the face sprayed 4 of the roll that comprises therefore a central portion 41 sprayed by the central series 31 of the ramp 3 and extended, on each side, respectively by a first lateral portion 43 sprayed by the first section 33 of the lateral series 32 and a second lateral portion 44 sprayed by the second section 34.

In the central portion 41 and the first lateral portions 43*a*, 43*b*, the impact surfaces of the jets are spaced regularly by the pitch (a) corresponding to the constant spacing of the spraying members. Conversely, the second lateral portions 44*a*, 44*b*, placed respectively at both ends of the cooled zone 4 make up transition zones in which the impact surfaces are closer, which enables controlling, with greater accuracy, the thermal effect of the spraying in order to compensate for possible residual defects observed downstream on both edges of the band.

Since, at both ends, the fluid jets converge inwardly, the total length of the ramp 3 must be slightly greater than the total length of the cooled zone 4.

If the band to be rolled exhibits a width far smaller than the maximum width $L_1$, the adjustment system of the flow rates determines the closing of the valves of a certain number of spraying members that constitute, at each end of the ramp, a third section of the lateral series 32*a*, 32*b* whose valves are closed. In such a case, both cursors 6*a*, 6*b* are moved towards the inside in order to engage, respectively, at each end of the effective portion of the ramp 3 whose valves are open, on a group of spraying members whose jets converge to a transition zone 44 of the cooled surface 4 of the roll, at each end of the said surface.

To take into account the convergence of the jets, this portion of the ramp whose valves are open, must cover a greater length than that of the cooled zone 4 of the roll that is itself, preferably, slightly greater than the actual width of the product (L). Thus, each transition zone 44*a*, 44*b* extends outwardly, beyond the edge 13*a*, 13*b* of the band, the better to avoid discontinuity in the distribution of the loads, while controlling the profile of the back-up generatrix over a transition zone thereby covering the edge of the band completely.

Figure 5:
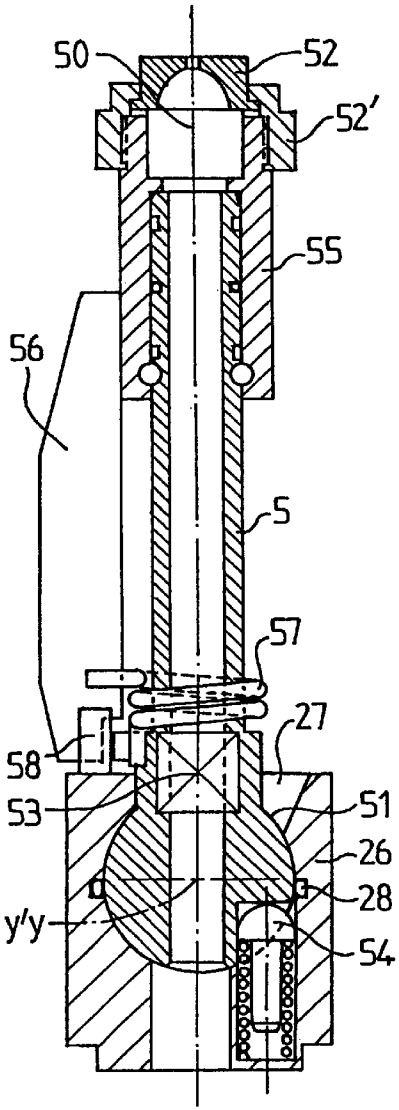
FIG. 5 is an axial sectional view of a spraying member.

FIG. 5, represents as an axial section, a spraying member A' of pivoting type comprising, as usual, a tubular body 5 delineating an injection channel centred on an axis 50 and having an inlet end 51 linked by a connection piece 26 to the supporting block 20 not represented on FIG. 5 and an outlet end provided with a nozzle 52 comprising a slot in order to form a flat jet of fluid.

In the central series 31 of the ramp, the tubular body 5 is fixed rigidly to the connection member 26. Conversely, in a lateral series 32, the inlet end 51 of the tubular body 5 consists of a spherical portion 51 located in a casing made of two parts and forming the connection member 26, in order to constitute a joint articulation with a simple assembly clearance. Tightness is ensured by an annular joint 28 placed between both parts of the casing 26. The said casing is machined so that it contains two plane faces parallel to the axis x'x of the working roll and on which are installed two flats 53 provided at the base of the tubular body 5. The said body can thus pivot only around an axis perpendicular to both faces 53, so that the axis 50 of the tubular body 5 moves on a plane. As stated, the supporting block 20 is oriented so that this plane runs substantially through the axis x'x of the working roll 1.

The casing 26 is provided, on the side of the tubular body 5, with an indented portion 27 that opens on one side only in order to steer, on this side, the tubular body 5 against the action of a spring-loaded pusher 54 that, failing any external stresses, presses the tubular body 5, in the opposite direction, against the casing 26 in the position represented on FIG. 5 for which the axis 50 of the tubular body is perpendicular to the axis x'x of the roll.

The nozzle 52 is mounted on a tip 55 that is immobilised in translation with respect to the tubular body 5, but can rotate around the axis 50 of the said body.

Preferably, the nozzle 52 is applied and fixed to the tip 55 via a clamping flange 52' provided with a nut. It is thus possible to adjust a tilting angle (k) of the middle plane $P_3$ of the jet with respect to the axis x'x of the roll 1.

In the central section 31 of the ramp 3, the nozzles 52 are adjusted so that the impact surfaces S are parallel.

The same goes for the lateral sections 32, when the axis 50 of the jet is perpendicular to the axis x'x of the roll.

However, according to another advantageous feature of the invention, each steerable spraying member A' is provided with a means for varying the tilting angle (k) of the middle plane of the jet in relation to the orientation variation (i) of the axis 50 of the said jet. Such a device will be described more in detail below.

Figure 10:
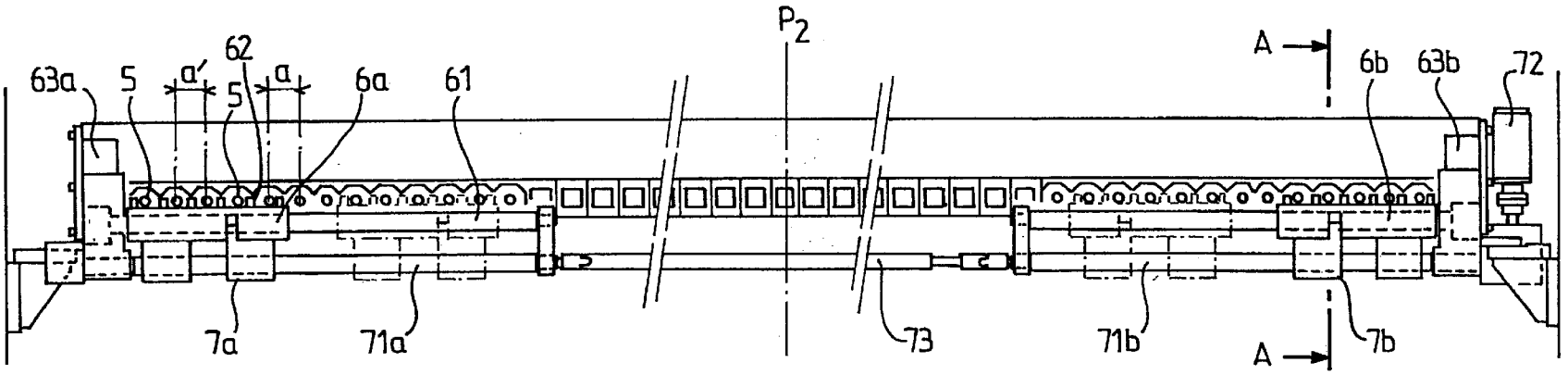
FIG. 10 shows the whole spray ramp, as a longitudinal section along the line DD of FIG. 7.
Figure 11:
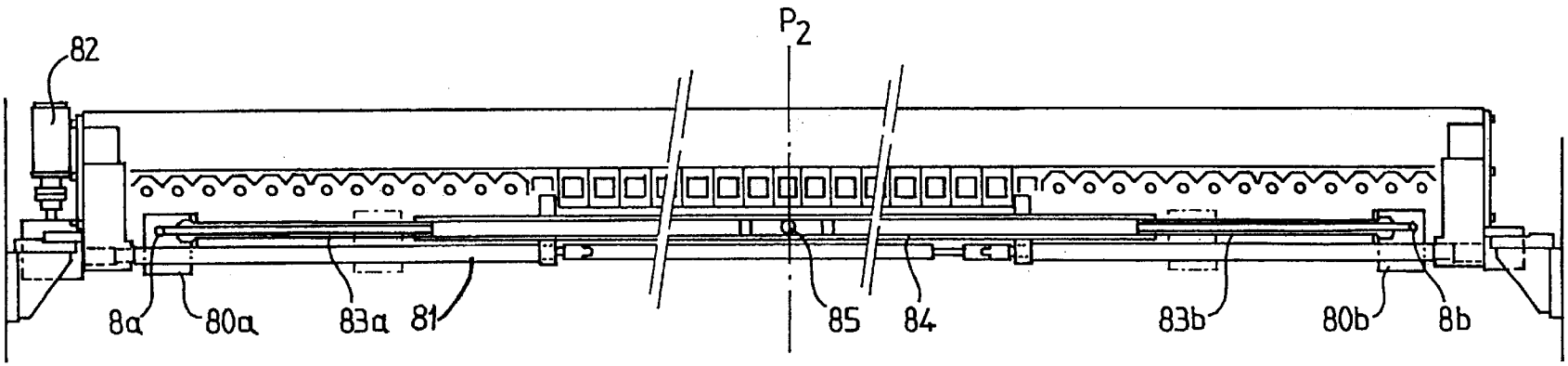
FIG. 11 is a longitudinal sectional view along the line EE of FIG. 8.

FIGS. 10 and 11 represent, respectively as a front view and a top view, the whole spraying ramp with the steering control system of the spraying members.

At each end of the ramp is arranged a cursor 6 that is mounted to slide, without any possibility of rotation, on a shaft 61, while running beneath the spraying members A' of the ramp 3. This cursor 6 carries a plurality of fingers 62 spaced regularly and protruding in order to run between the tubular bodies 5 of a group of spraying members A'2. Thus, in the example represented on FIG. 10, which corresponds to FIG. 3, each cursor 6 carries six fingers 62 that extend each at the tubular body 5 of a spraying member A'2 in order to rest laterally on the said member when the cursor 6 slides along the shaft 61.

This sliding motion is controlled by a nut 7 engaged on a screw 71 and locked in rotation in order to move longitudinally, with the cursor 6 when the screw 71 is driven into one direction or the other, by a hydraulic engine 72.

The fingers 62 of the cursor 6 are spaced by a constant pitch (a') that is slightly smaller than the pitch (a) between the axes 50 of the spraying members A. Thus, as can be seen on FIG. 10, when the cursor 6 slides along the shaft 61, the six fingers 62 of the cursor rest successively on the corresponding tubular bodies 5 of six spraying members A'2. The said members start therefore to pivot one after the other and consequently, the tilting angle (i) of the axis 50 of a spraying member 5 with respect to the axis x'x of the roll decreases from the inside to the outside, as represented on FIG. 3.

As shown on FIG. 10, the arrangement is symmetrical with respect to the plane $P_2$ of symmetry of the rolling mill, whereas the device comprises two cursors 6*a*, 6*b* whose displacements in reverse direction are controlled by two screws 71*a*, 71*b* with reverted threads that are connected by an extension 73. A hydraulic engine 72 using an intermediate angle controls the rotation of both screws, in one direction or the other.

It is thus possible, while moving both cursors 6*a*, 6*b* in reverse direction, to place them, respectively, at two groups of spraying members A'2 symmetrical with respect to the plane $P_2$ and constitute, respectively, the second sections 34*a*, 34*b* of both lateral series 32*a*, 32*b* of the ramp 3.

Each cursor 6*a*, 6*b* is thus placed close to a group of spraying members A'2 whose jets converge toward a transition zone 44*a*, 44*b* at each end of the cooled zone 4 of the roll.

Using the hydraulic engine 72, the rotation of the screws 71*a*, 71*b* can be controlled in one direction or the other to place both cursors 6*a*, 6*b* at the requested level. Each cursor can then move between two limit positions corresponding to both ends of each lateral series 32*a*, 32*b*, respectively, an external position represented as a full line on FIG. 10 and an internal position represented as a dotted line.

To this end, the fingers 62 of each cursor 6 engage removably between the tubular bodies 5 of the spraying members.

Figure 9:
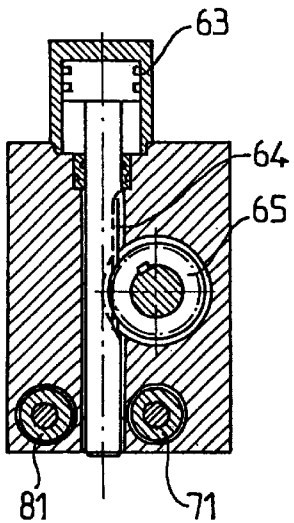
FIGS. 7, 8 and 9 are cross sectional views, respectively along the lines AA, BB, CC of FIG. 6.
Figure 6:
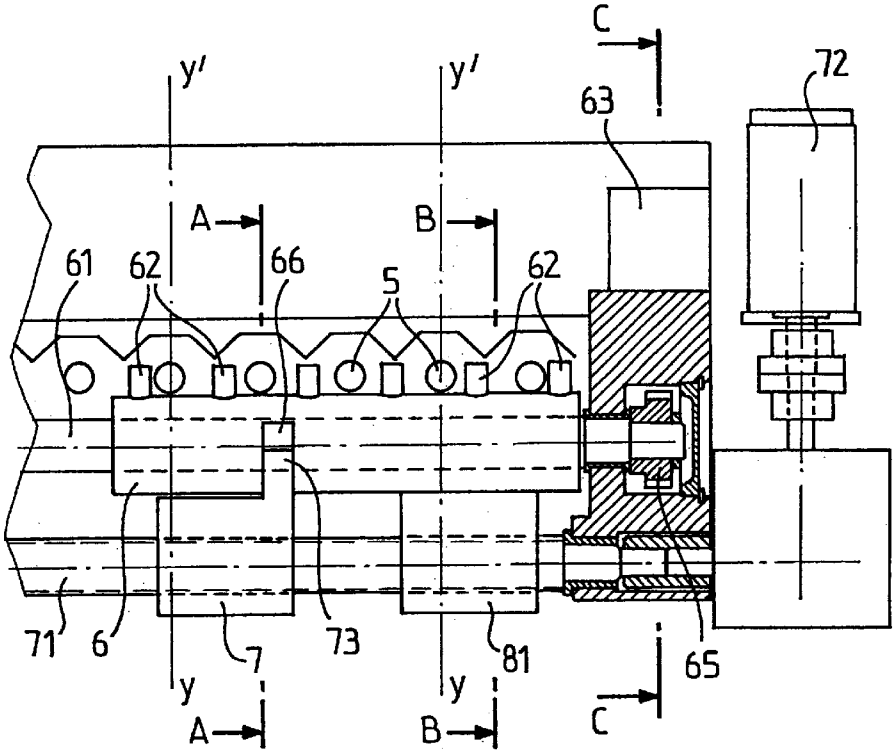
FIG. 6 is a schematic view, in longitudinal section, of the end of a spray ramp.

Consequently, as shown on FIGS. 6 and 9, each cursor 6*a*, 6*b* is associated with a pneumatic actuator 63 whose stem carries a rack 64 on which engages a toothed wheel 65 wedged at the end of the guiding shaft 61 of the cursor 6.

Figure 7:
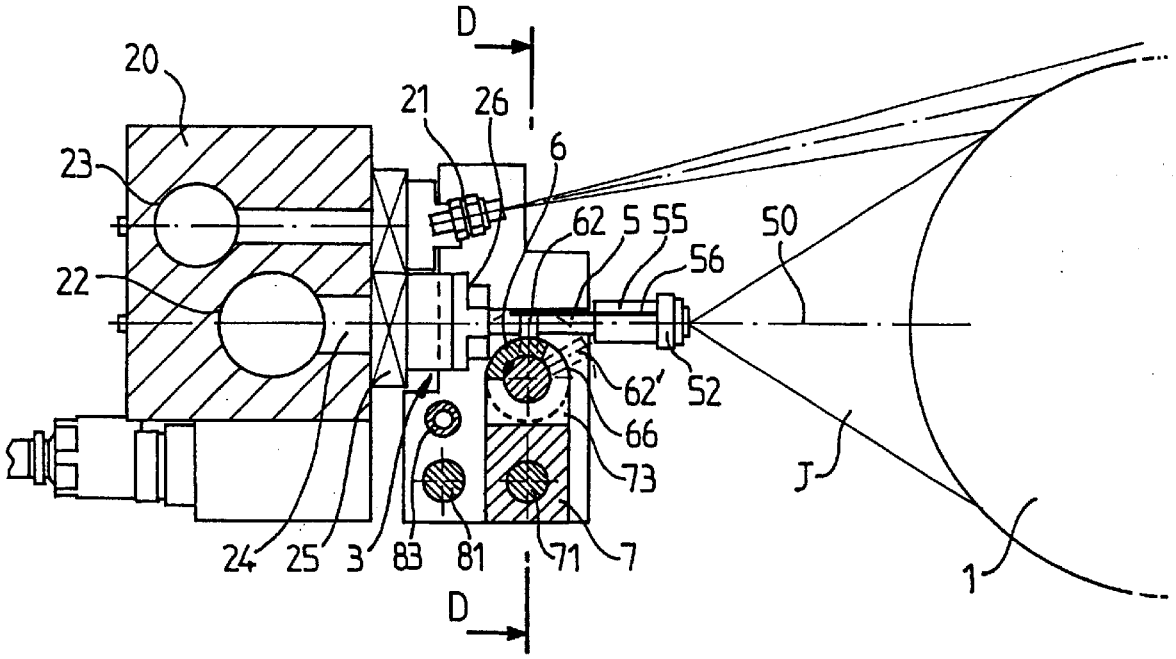

As shown on FIG. 7, the cursor 6 consists of a tubular sleeve mounted to slide axially along the shaft 61, but wedged in rotation with the said shaft. Thus, a rotation of the shaft 61 controlled by the pinion 65 and the rack 64 determines the rotation of the cursor 6 with, in one direction, the engagement of the fingers 62 between the tubular bodies 5 of the corresponding spraying members and, in the other direction, their disengagement in the position 62' represented as a dotted line on FIG. 7. In this position 62', the fingers are placed beneath the level of the spraying members and hence do not oppose the sliding motion of the cursor 6.

Besides, the nut 7 is provided with a protruding driving piece 73 that engages into a circular groove 66 of the cursor 6 enabling the rotation of the said cursor around its axis.

It is therefore possible, according to the width of the band, to adjust the position of the cursor first in disengaged position of the fingers, to select the group of spraying members making up the second lateral section of the ramp and then, in engaged position, to cause the orientation of the nozzles to vary.

To this end, the hydraulic engine 72 intended for moving the cursors is provided with a two speed control operated by a pulse generator in order to realise, rapid displacement of the cursors 6*a*, 6*b* on the one hand for selection of the group of spraying members to be steered and, fine adjustment of the position of the cursor, on the other hand, to determine optimum reduction of the spacing pitch of the impact surfaces in relation to the edge defects to be corrected.

Figure 4:
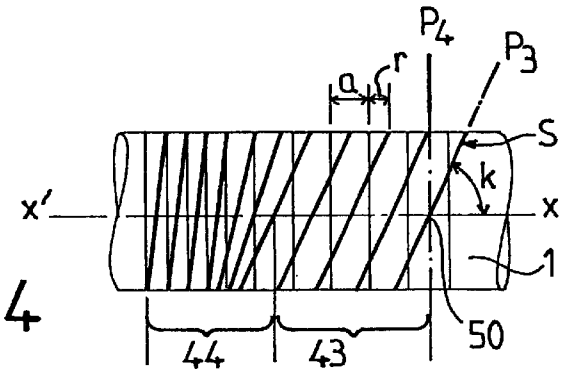
FIG. 4 shows schematically the distribution of the impact surfaces of the jets at the end of the cooled zone of a roll.

FIG. 4 represents schematically the impact surfaces S of the jets on the cooled face of the working roll 1.

As already stated, the axis 50 of each spraying member 5 is substantially concurrent with the axis x'x of the roll 1 and the nozzle 52 forms a thin flat jet, that is centred in a middle plane $P_3$ cutting transversally the axis x'x. The nozzles 52 are adjusted so that the middle planes $P_3$ of the impact surfaces S are parallel and tilted by the same angle (k) with respect to the axis x'x of the roll. Thus, in spite of the small width of the impact surface, the cooling effect is applied not only over the whole width (a) of the zone corresponding to the jet considered, but also over a portion of both adjacent zones, whereas the overlapping (r) can be, for example, half the pitch (a). Thus, since the opening or the closing of each valve 25 is controlled by all or nothing, the cooling effect is distributed over the whole length of the face sprayed 4 of the roll 1.

In the first lateral portion 43*a* of the cooled zone, the axes 50 of the spraying members are spaced apart from one another by the same pitch (a) and the middle planes $P_3$ of the jets are parallel and tilted by the same angle (k) with respect to the axis x'x of the roll 1. Conversely, in the transition zone 44, the spraying members are oriented in order to reduce the distance between the axes of the jets up to a pitch that can be, for example, half the constant pitch (a) in the central portion 41 and the first lateral portion 43.

As stated, it is advantageous to cause the tilting angle (k) of the middle plane of a jet to vary in relation to the change of orientation of its axis 50 with respect to the axis x'x of the roll.

To this end, the tip 55 on which is fixed the nozzle 52 is provided with a blade 56 on which rests a torsional spring 57 whose opposite end engages into a hole of the tubular body, at the inlet end of the said body. Failing any external stresses, the blade 56 is applied by the spring 57 against a stud 58 fixed to the connection member 26 and the middle plane $P_3$ is then tilted by the angle (k) corresponding to the adjustment of the nozzle.

Thus, when the cursor 6 is rotated to engage the fingers 62 between the tubular bodies 5, each of them rests on the blade 56 and lifts the blade, against the effect of the spring 57, while turning the tip 55 carrying the nozzle 52. There is a rotation of the middle plane $P_3$ of the fluid jet J around the axis 50 of the nozzle.

It is thus possible, in both transition zones where the spacing pitch is smaller, to increase the tilting angle of the jets with respect to the axis of the roll, in order to avoid any interferences between the adjacent impact surfaces that are closer to one another than in the central zone.

Moreover, it is particularly advantageous to cause the length of the fingers 62 to vary in relation to their position on the cursor.

Indeed, the variation of the tilting angle (k) of the middle plane $P_3$ of a jet depends on the length of the corresponding finger 62. While increasing progressively the length of the fingers, from the inside to the outside, it is hence possible to determine gradual straightening of the jet, starting from the section 43 to the end of the zone 44. Thus, as shown on FIG. 4, the overlapping ($r_1$) between two neighbouring impact surfaces is reduced in the same way as their spacing ($a_1$) and remains in the order of half the said spacing. Moreover, the progressive variation of the tilting angle (k) enables to avoid any interferences between the impact surfaces S, on the side where the said surfaces converge.

Figure 12:
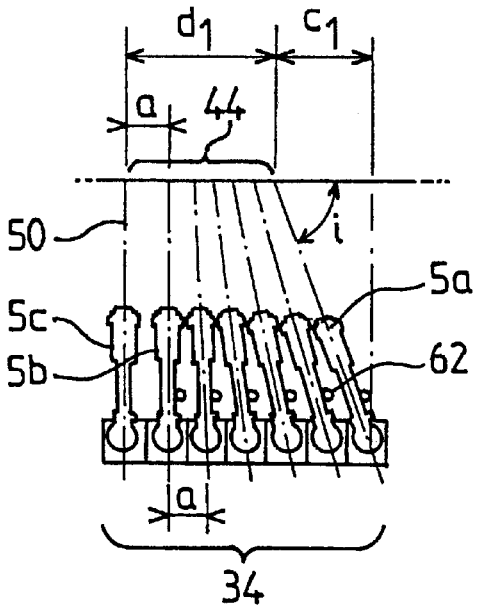
Figure 12:
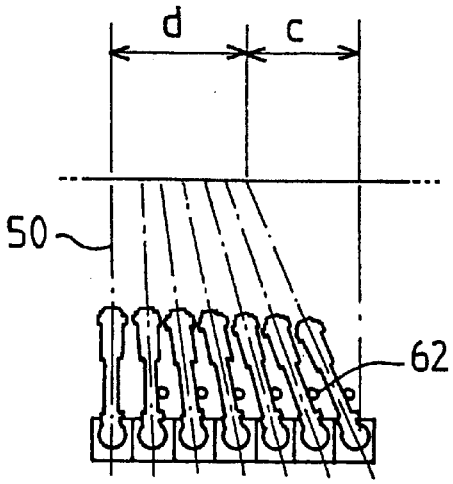
Figure 12:
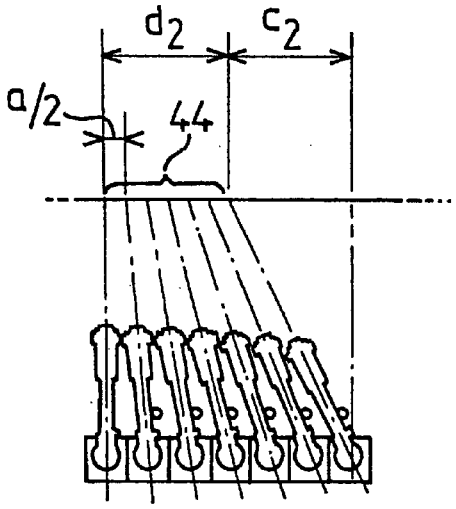

For example, FIG. 12 shows, in three successive diagrams, the progressive displacement of the cursor 6 with respect to a starting position, which determines the progressive tilting of the jets and the tightening of the impact surfaces.

FIG. 12*a* shows the position of the cursor 6 from which all the fingers 62 are brought in contact with the spraying members forming the steerable section 34 of the ramp. The tilting angle (i) of the axes 50 of the fluid jets increases therefore gradually from the first nozzle 5*a* to the last nozzle 5*b* of the section 34, which, in this position of the cursor, is still directed perpendicular to the axis of the roll.

The centre of the jet of the first nozzle 5*a* of the series is then located at a distance ($c_1$) of the starting position of the cursor 6, in which the same jet was perpendicular to the axis of the roll and the transition zone 44*a* extends over a width ($d_1$) up to the axis of the first nozzle 5*c* of the section 33. In this position, the last nozzle 5*b* of the section 34 has not started to pivot yet and its axis is thus located at the distance (a) of the axis of the nozzle 5*c*, for instance 50 mm.

FIG. 12*b* shows an intermediate position and FIG. 12*c* shows the final position for which the axes of the jets are spaced regularly by the semi-pitch (a/2), for example 25 mm.

It can be seen that the transition zone has moved slightly inside, whereas the distance ($c_2$) has increased and that, at the same time, its width ($d_2$) has slightly decreased with respect to the initial width ($d_1$).

The adjustment of the position of the cursor thereby enables, on the one hand, to change the spacing and the tilting angle of the jets and, on the other, to modify slightly the width of the transition zone and the relative positions of the jets with respect to the edge of the band.

Thus, in addition to the adjustment of the average flow rate of the jets, there is an additional cooling means controlled, by sections, of the portion of the roll corresponding to an edge of the band.

Besides, as stated above, the progressive tightening of the axes of the jets is accompanied by a progressive straightening of their middle planes, which enables ensuring regular distribution of the fluid over the whole height of the cooled face 4.

It is thus possible to adjust the thermal effect of the jets very accurately in order to correct the residual defects observed on both edges of the band.

Obviously, the invention is not limited to the embodiments that have just been described and that could be subject to variations without departing from the scope defined by the claims.

In particular, it is only for exemplification purposes that the steering control means of the nozzles has been described, whereby other means could obviously be used to obtain the same results.

Moreover, if the nozzles used currently correspond, normally, to a spacing pitch of 50 mm approximately, it is certain that this spacing depends on the material available and on the characteristics of the rolling mill on which the device is installed.

As stated, each nozzle is usually provided with a slot intended for the formation of flat jet with a substantially rectangular section, but several orifices can also be used, distributed as a fan pattern and whose jets are overlapped in order to form, on the roll, an oblong impact surface, with small width.

Besides, to improve the control efficiency of the spraying on the edges of the rolled band, it is advantageous to add, on each edge, an additional spraying member 8 which can be moved along a support 81 parallel to the screw 71 intended for controlling the movements of the cursor 6.

Figure 8:
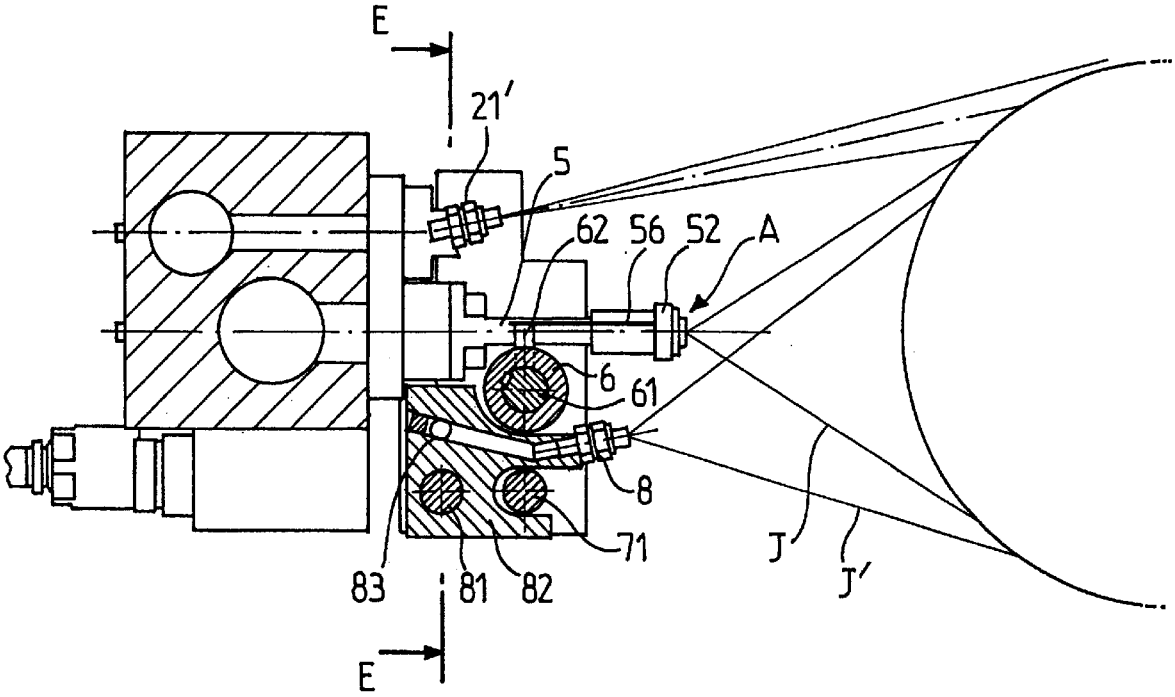

In this end, as shown on FIG. 8, each additional spraying member 8 placed on one side of the band is mounted on a cursor 80 that is formed in order to provide adequate passage of the first screw 71.

Each nozzle 8 is fed by a channel provided inside the cursor 80 and on which is connected, via an articulated joint, a supply duct 83, as represented on FIG. 11. This duct 83 is mounted to slide, in a tight fashion, in a fixed tube 84 that extends on either side of the plane of symmetry $P_2$ and is connected to a central supply 85.

Each additional nozzle 8 forms a flat jet J', preferred oriented vertically and that may move under the effect of the screw 81, in order to be positioned accurately in relation to the defect to be corrected.

As shown on FIG. 11, the support 81 consists of two screws with reverse pitch connected by an extension and engaging respectively into threaded bores provided on each cursor 80*a*, 80*b*. A hydraulic engine 82 controlling the rotation of the screw 81 determines equal displacements, in reverse direction to the cursors 80*a*, 80*b* and hence enables adjusting the positions of the jets J' of both nozzles 8*a*, 8*b* in relation to two edges of the band, whereas the corresponding ducts 83*a*, 83*b* slide in both ends of the central tube 84.

A pulse generator enables to control these displacements, in reverse direction, of both cursors 80*a*, 80*b* in order to adjust accurately the position of both nozzles 8*a*, 8*b* with respect to both edges of the band.

Using the central supply 85, both nozzles 8 can be fed at another temperature than the nozzles A of the ramp 3, whereas the heat exchanging fluid can, by the way, be of another nature.

It appears therefore that the invention provides with several means of thermal control whose effects can be combined in order to obtain as perfect a flatness quality as possible.

It should be noted that the invention does not apply only to new installations, but also enables to improve the performances of the older installations. Indeed, the spraying ramps and the related mechanisms constitute compact assemblies that can be installed easily, even in an existing roll stand.

The reference signs inserted after the technical features mentioned in the claims solely aim at facilitating the understanding of the said and do not limit their extent whatsoever.

What is claimed is:

1. A method for thermal control of the profile of a roll in a mill comprising running control means, between at least two rolls with parallel axes, of a product to be rolled consisting of a band with two edges spaced apart by a certain width and in which at least one roll is associated with at least one ramp for spraying a heat exchanging fluid comprising a plurality of spraying members spaced apart from one another along a direction parallel to the axis of the roll and each provided with a nozzle for spraying a jet of fluid centred on an injection axis passing substantially through the axis of the roll and each jet of fluid forming, on the roll an oblong impact surface with a greater, middle axis placed on a middle plane transversally cutting the axis of the roll, each spraying member being provided with a valve operated by a flow rate adjustment system for the spraying of the roll, said flow rate adjustment system opening the valves over a portion of the ramp thereby determining the spraying of the fluid over a cooled zone of the roll and closing of the valves over the remaining portions of the ramp, the cooled zone being defined by a series of said impact surfaces having said middle axes spaced apart by a distance, the adjustment system governing the average flow rate individually, by time unit, of each of the spraying units thereby adjusting the fluid jet sprayed onto each impact surface, the method comprising: varying the distance between the middle axes of the impact surfaces in relation to the position of the impact surfaces over the length of the cooled zone so that the cooled zone comprises a central zone in which the impact surfaces are spaced by a substantially constant pitch and two transition zones extending on either side of the central zone at least up to the two edges of the band, wherein the spacing between the middle axes of the impact surfaces in each of the transition zones is reduced with respect to the constant pitch of the central zone.

2. A control method according to claim 1, further comprising tilting each fluid jet centred on a middle plane by a non-right angle with respect to the axis of the roll so that the corresponding impact surface extends transversally on the roll while flaring away symmetrically with respect to the injection axis, on either side of a transversal plane passing through the injection axis and perpendicular to the axis of the roll.

3. A control method according to one of claims 1 and 2, wherein in a central portion of the spraying ramp corresponding to the central zone of the cooled zone, each fluid jet is directed along an injection axis perpendicular to the axis of the roll and in two lateral portions of the ramp, on either side of the central portion corresponding to the transitions zones, the orientation of the axis of each jet with respect to the axis of the roll are caused to vary, so that the jets of a certain number of nozzles of both lateral portions of the ramp may converge respectively toward the two transition zones of the roll, the number of convergent jet nozzles being determined such that, taking into account their distribution on the ramp, each lateral portion of the ramp covers a length greater than a length of the corresponding transition zone of the roll.

4. A control method according to claim 3, wherein the middle planes of the jets directed to the central zone of the roll are tilted by a same non-zero angle with respect to the axis of the roll and the tilting angle of the middle planes of the jets directed respectively towards both transition zones is increased.

5. A method according to claim 4, wherein in each transition zone, a progressive decrease of the tilting of the axis of the fluid jets and a progressive increase of the tilting of their middle plane with respect to the axis of the roll, are defined with respect to the central zone and while flaring away outwardly.

6. A device for thermal control of the profile of a roll in a mill, the mill including at least two rolls having parallel axes and means for displacement control, between the rolls, of a product to be rolled consisting of a band exhibiting two edges spaced apart by a width which is between a minimum width and a maximum width of the product, said thermal control device being associated with at least one of the rolls of the mill, said thermal control device comprising at least one spraying ramp having a plurality of spaced spraying members distributed over a whole length of the roll, parallel to the axis of the roll and connected to a heat exchanging fluid supply circuit, wherein each spraying member is provided with a valve and a nozzle to form a fluid jet centred on an injection axis passing substantially through the axis of the roll, each jet of fluid forming, on the roll, an oblong impact surface with a greater, middle axis placed on a middle plane of the jet transversally cutting the axis of the roll, a flow rate adjustment system of the flow rates sprayed by individual control of the valves of each spraying member, said adjustment system opening the valves over a portion of the ramp for the spraying of fluid over a cooled zone of the roll and closing the valves over the remaining portions of the ramp, the adjustment system providing individual adjustment of the average flow rate, by time unit, of each of the spraying members, thereby adjusting the fluid jet sprayed onto each impact surface, wherein the spray ramp comprises at least three series of spraying members, including a central series covering a central portion of the cooled zone over a length of the roll not exceeding the minimum width of the product and in which the spraying members have fixed directions so that the injection axes are spaced by a constant pitch in the central portion of the cooled zone, and two lateral series extending on either side of the central series to cover, in total with the central series, a length at least equal to the maximum width of the product, and in which the spraying members in each of the lateral series are pivotally mounted on the ramp, said device further comprising a means associated with each lateral series for adjusting the orientation of at least one group of pivoting spraying members in each lateral series, in order to reduce the spaces between the middle axes of the impact surfaces at each end of the cooled zone of the roll.

7. A thermal control device according to claim 6, wherein when the mill and the band to be rolled are symmetrical with respect to a longitudinal plane, each lateral series of spraying members comprises, going from the inside to the outside, a first section in which the injection axes of the jets are orthogonal to the axis of the roll and that covers a first lateral portion of the cooled zone of the roll over such a length that a total length of the central portion of the cooled zone, increased with said first lateral portions is smaller than the width of the band, and a second section in which the injection axes of the jets are pivoted inwardly with respect to the axis of the roll and that covers a second lateral portion of the cooled zone over such a length that the total length of the said cooled zone is at least equal to the width of the band, wherein a pitch of the middle axes of the impact surfaces of the spraying members in each first section is equal to the constant pitch of the central section, each second section of a lateral series covers, at one end of the cooled zone, a transition zone corresponding to one edge of the band and in which the middle axes of the impact surfaces are spaced apart by a distance smaller than the constant pitch of the surfaces in the central portion and the first lateral portions.

8. A device according to claim 7, wherein the means for adjusting the orientation comprise two control means for controlling the pivoting of a group of spraying members, respectively in each lateral series of the ramp, each control means being movable along the ramp, a means for adjusting a position of each control means along the ramp in relation to the width of the band, and a means for selective engagement of each control means with a group of spraying members making up a second section of each lateral series to cover the transition zone, at each end of the cooled zone.

9. A device according to one of the claims 6 to 8, in which the spraying ramp comprises a supply duct connected to a fluid supply system and to which are connected a plurality of spraying members spaced apart, wherein the spraying members are spaced from one another by a minimum distance that depends on the space requirements in width of each spraying member and determines the constant pitch between the middle axes of the impact surfaces in the central portion and the first lateral portions of the cooled zone.

10. A device according to claim 9, in which each spraying member comprises a tubular body having an outlet end provided with a nozzle to form the jet and an inlet end connected to the supply duct via a connection piece delineating a junction channel between the supply duct and the inlet end of the tubular body, on which is placed the valve connected individually to the adjustment system, wherein each spraying member of each lateral series of the ramp has the tubular body mounted pivoting on the connection piece around at least one pivoting axis orthogonal to the axis of the roll, and a control system is provided for the rotation of the tubular body around said pivoting axis.

11. A device according to claim 10, wherein the connection piece of each spraying member of the lateral series comprises a casing delineating a cavity with an internal circular face centred on the pivoting axis orthogonal to the axis of the roll, and the tubular body of the spraying member is provided with a circular reach having a profile which matches that of the cavity and housed in the cavity with a simple assembly clearance.

12. A device according to claim 11, wherein the tubular body of the spraying member of the lateral series is mounted rotatable inside the cavity of the casing and comprises at least one plane guiding surface parallel to the axis of the roll and resting on a corresponding plane face of the casing in order to enable the tubular body to pivot around the pivoting axis perpendicular to said plane guiding surface.

13. A device according to claim 10, wherein each spraying member of the lateral series comprises a means for adjusting a tilting angle of the middle plane of the jet with respect to the axis of the roll.

14. A device according to claim 13, wherein the nozzle of each spraying member is mounted rotatable on the tubular body around the injection axis of the jet and said means for adjusting the tilting angle includes a means for controlling the rotation of the nozzle around the injection axis of the jet for adjusting the variation of the tilting angle of its middle plane with respect to the axis of the roll.

15. A device according to claim 9, wherein each lateral series of spraying members is associated with a means for selective control of the pivoting of a group of spraying members.

16. A device according to claim 15, wherein the means for selective control of orientation comprises a cursor having fingers spaced apart and being mounted to slide on a support extending along the ramp, a means for controlling the sliding motion of the cursor on the support for adjusting the position of the cursor along the ramp, and a means to control the rotation of the cursor around an axis into two opposite directions, respectively, an engagement direction and a disengagement direction of the fingers of the cursor between the tubular bodies of a group of spraying members of the ramp.

17. A device according to claim 16, wherein the means for controlling the sliding motion of the cursor comprises a means for rapid control of the sliding motion of the cursor along its support, in order to select the group of spraying members to be pivoted, in relation to the width of the band, and a means for slow control of the sliding motion of the cursor for fine adjustment of the orientations of the jets sprayed by the group of spraying members.

18. A device according to claim 16, wherein the fingers of the cursor are spaced apart by a constant distance that is slightly smaller than a distance between the injection axes of the tubular bodies of two neighbouring spraying members, whereby said fingers of the cursor rest one after the other on the tubular bodies as the cursor is sliding, in order to determine progressive variation of the pivoting angles of the jet injection axes with respect to the axis of the roll.

19. A device according to claim 16, wherein the nozzle of each spraying member of the lateral series is mounted rotatable on the tubular body around injection axis of the jet, and means are provided for rotating the nozzle, actuated by the cursor.

20. A device according to claim 19, wherein the fingers of the cursor engage between the tubular bodies of a group of spraying members by rotation of the cursor around the axis of the cursor, and the rotation means of the nozzle of each spraying member of the lateral series comprises a blade rotating together with the nozzle and on which rests the corresponding finger of the cursor when the cursor rotates for engaging the fingers, the engaging motion determining rotation of the nozzle around the injection axis of the jet.

21. A device according to claim 20, wherein a length of each of the fingers provided on the cursor increases from the inside to the outside, in order to delineate progressive increase of the tilting angle of the jet while going towards the ends of the cooled zone of the roll.

22. A thermal control device according to claim 6, further comprising additional means for spraying a jet of fluid, respectively onto each edge of the band, each additional means including at least one additional spraying member mounted to slide on a support, parallel to the axis of the roll and associated with a means for controlling displacements of the at least one additional spraying member in relation to the width of the band to adjust the position of the resulting impact surface with respect to the edge of the band.

23. A device according to claim 22, further comprising separate means for supplying said at least one additional spraying member with fluid.

24. A device according to claim 22, wherein two additional spraying means are mounted to slide on the same support and means are provided for controlling equal displacements, in opposite directions, of both additional spraying means on the support.

25. A device according to claim 22, wherein said additional spraying means is carried by an additional cursor provided with a threaded bore in which engages a screw brought into rotation by an engine and comprising two portions provided with reverted threads delineating equal spacings and in reverse directions of both cursors.

* * * * *